US005118284A

United States Patent [19]

Mutchler

[11] Patent Number: 5,118,284

[45] Date of Patent: Jun. 2, 1992

[54] COMBUSTION APPARATUS FOR FLUID FUELS AND METHOD OF COMBUSTING FUEL-AIR MIXTURES

[75] Inventor: Paul A. Mutchler, University, Mo.

[73] Assignee: Engineered Air Systems, St. Louis, Mo.

[21] Appl. No.: 650,023

[22] Filed: Feb. 4, 1991

[51] Int. Cl.[5] ..... F23M 3/04

[52] U.S. Cl. ..... 431/10; 431/352

[58] Field of Search ..... 431/352, 10; 60/755, 60/756, 752

[56] References Cited

U.S. PATENT DOCUMENTS

| | | | |
|---|---|---|---|
| 305,439 | 9/1984 | Doane . | |
| 1,426,815 | 8/1922 | Burgstaller . | |
| 2,595,999 | 5/1952 | Way et al. | 60/752 |
| 3,368,604 | 2/1968 | Mutchler . | |
| 3,574,508 | 4/1971 | Rothnaar . | |
| 3,586,300 | 6/1971 | Monroe | 431/352 |
| 3,588,304 | 6/1971 | Guth | 431/352 |
| 3,881,863 | 5/1975 | Creuz | 431/352 |
| 4,023,923 | 5/1977 | Kramer | 431/352 |
| 4,113,425 | 9/1978 | VonLinde et al. . | |
| 4,203,719 | 5/1980 | Brandt . | |
| 4,369,027 | 1/1983 | Saito et al. | 431/350 |
| 4,523,905 | 6/1985 | Lewis . | |
| 4,963,089 | 10/1990 | Spielman | 431/352 |

*Primary Examiner*—Carroll B. Dority

[57] ABSTRACT

An improved fuel burning combustion apparatus and method of combusting a fuel-air mixture wherein the apparatus includes a burner housing having a plurality of angularly adjoined flat wall panels to define a burner chamber of preselected geometric configuration having tangentially disposed combustion air inlets and air turbulence forming areas extending longitudinally along the angularly adjoined flat wall panels to provide a thorough mixing of air and fuel introduced into the burner chamber.

15 Claims, 1 Drawing Sheet

COMBUSTION APPARATUS FOR FLUID FUELS AND METHOD OF COMBUSTING FUEL-AIR MIXTURES

BACKGROUND OF THE INVENTION

The present invention relates to air heaters and more particularly to an improved combustion apparatus for fluid fuels and method of combusting fuel-air mixtures which includes a unique burner structure that enhances fuel-air intermixture for ignition in the burner assembly.

It long has been known to introduce combustion supporting air into a longitudinally extending burner assembly through a plurality of spaced apertured air inlets extending along the length of a burner housing, attention being directed to the long since expired U.S. Pat. No. 305,439, issued to T. P. Doane on Sep. 23, 1884 and to U.S. Pat. No. 1,426,815, issued to M. Burgstaller on Aug. 22, 1922. Further attention is directed to the more recent U.S. Pat. No. 3,574,508, issued to C. W. Rothhaar et al on Apr. 13, 1971, which teaches introducing air in a burner assembly mixing cone through canted apertures to develop a swirling of the air about the cone center axis to enhance air-fuel intermixture; to the perforated double cone combustion chamber of U.S. Pat. No. 4,113,425, issued to Von Linde et al on Sep. 12, 1978; to the perforated evaporator tube of U.S. Pat. No. 4,203,719 issued to C. Brandt on May 20, 1980; and, to the apertured flat wall elements in U.S. Pat. No. 4,523,905, issued to D. Lewis on Jun. 18, 1985.

None of these aforenoted, patents, however, teaches or suggests the novel burner assembly and method of the present invention which utilizes a unique burner conformation to provide air stream impingement, agitation and turbulence along the periphery of the confining burner walls and which serves to both enhance fuel-air mixing and to avoid excessive heating and carbon build-up. The novel arrangement of the present invention further serves to maximize air pressure usage and to allow ready air control in comparatively shorter burner assemblies. Further, the present invention serves to provide a unique structure to reduce the flame propagation rate in a burner assembly and to provide comparatively low operating noise levels. In addition, the present invention provides a straightforward and comparatively economical burner structure which can be readily manufactured and assembled in different appropriate sizes to meet various heating demands with a minimum of manufacturing and assembly steps.

Numerous other features of the present invention will become obvious to one skilled in the art upon reading the disclosure set forth herein.

BRIEF SUMMARY OF THE INVENTION

More particularly the present invention provides a burner assembly for fluid fuels comprising: a burner housing having a plurality of angularly adjoined flat wall panels to define a burner chamber of preselected geometric configuration with air agitating and turbulence forming areas extending longitudinally along the angularly adjoined flat wall panels to surround a central longitudinal axis of the burner chamber; the defined burner chamber having a fuel inlet means preselectively positioned to introduce fuel into the burner chamber and a combustion air inlet means preselectively positioned to introduce combustion air in flowing streams parallel to and along the adjoined flat wall panels defining the burner chamber to impinge with the air turbulence forming areas to agitate and provide a thorough fuel-air mixture in the turbulent air area surrounding the burner chamber; an ignition means cooperatively disposed in the burner chamber to ignite the fuel-air mixture into a flame; and, an outlet means for the flame and combustion products. In addition, the present invention provides a method of combusting fluid fuels comprising: atomizing and introducing atomized fluid fuels into a confined combustion zone; introducing air into the confined combustion zone to flow in flat parallel streams along the periphery of the confined zone; impinging the air streams introduced along the periphery of the zone to agitate and create an air turbulent state to mix with the atomized fuel in the zone; igniting the atomized fuel-air mixture while in the confined zone; and, passing the resulting flame and products of combustion from the ignited fuel-air mixture from the confined zone in a controlled manner. In addition, the present invention provides a unique manner for atomizing and igniting the fuel-air mixture and controlling the resulting flame and combustion products as they are emitted from the confined zone.

It is to be understood that various changes can be made by one skilled in the art in the several parts of the inventive apparatus and in the several steps of the inventive method without departing from the scope or spirit of the present invention. For example, the fuel can be atomized and introduced in several different ways from that of the manner disclosed, the combustion air can be introduced into the burner assembly through canted apertures if so elected, the agitation by impingement of the fluid stream parallel to and along the peripheral walls of the burner assembly can be varied and the flame and combustible products can be emitted from the burner assembly in a number of other ways.

BRIEF DESCRIPTION OF THE DRAWINGS

Referring to the drawings which disclose one advantageous embodiment of the present invention.

DETAILED DESCRIPTION OF THE DRAWINGS

Figure 1:
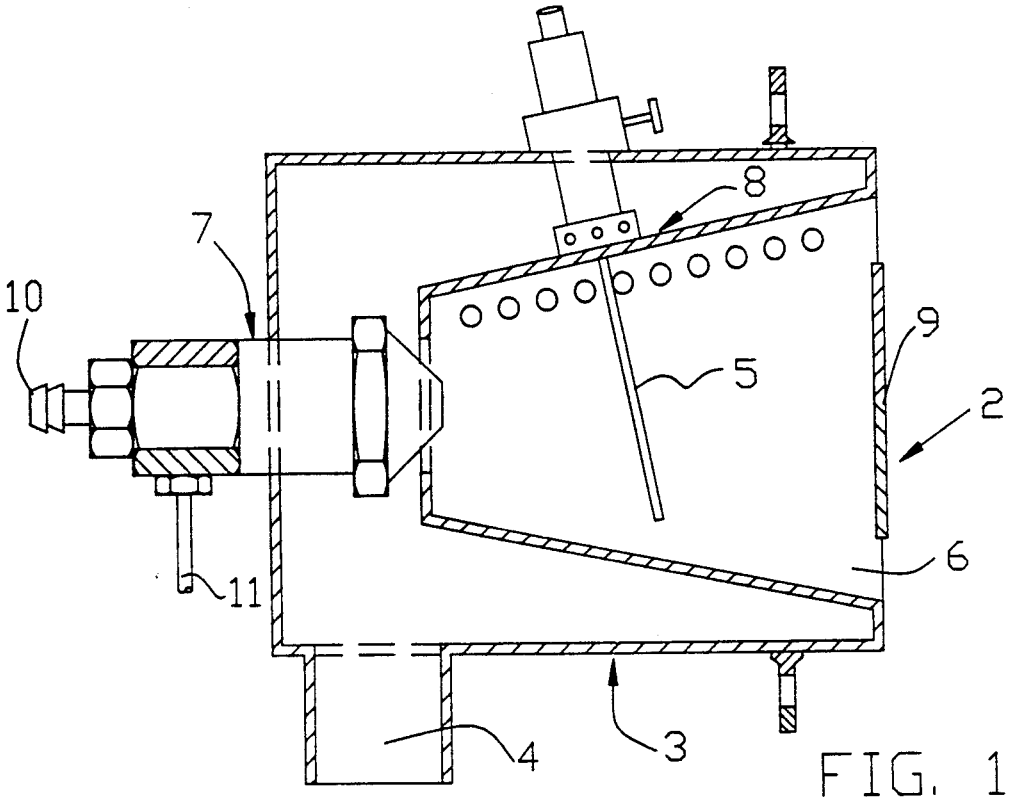
FIG. 1 is a schematic cross-sectional side view of a portion of the inventive apparatus.

Referring to FIG. 1 of the drawings, an improved combustion apparatus 2 for fluid fuels is disclosed which can be particularly useful for burning conventional liquid fuels in miniature sized burners to produce small heating inputs in the range of ten thousand (10,000) to fifty thousand (50,000) BTU per hour. It is to be understood, however, that the features of the present invention are not to be considered as limited to what is frequently referred to as miniature size burners, but that the inventive features can lend themselves to the construction of burners of various larger sizes including burners requiring outputs of ten or more times that required of miniature burners or of approximately five hundred thousand (500,000) BTU per hour. And, in fact, a satisfactory experimental burner of the novel design disclosed herein has been built to fire a commercial water heater requiring an output of four hundred and fifty thousand (450,000) BTU per hour or nearly ten times the burner size for which the present invention is particularly adapted.

Broadly described and referring to FIG. 1 of the drawings, combustion apparatus 2 includes an outer longitudinally extending, generally enclosed combustion air housing shell 3 which can be of cylindrical shape to include a combustion air inlet 4 in the side wall thereof and a flame and combustion products outlet 6 at one end wall thereof with a fuel atomizing nozzle 7 disposed in the opposite end wall to project therethrough and through a small aperture end wall of an outwardly tapering, frustum shaped burner assembly 8 which burner assembly is centrally disposed and supported in spaced relation from the inner wall of combustion air housing shell 3. In this regard, it is to be noted that the larger end extremity of burner assembly 8 engages and is fastened along the periphery of flame and combustion products outlet 6 of combustion air housing shell 3. In the embodiment disclosed in FIG. 1, a suitably sized restrictor plate 9 spaced from the periphery of outlet 6 can be mounted by appropriate support straps or spider (not shown) to the end wall of combustion air housing shell 3 to restrict the flame and combustion products ignited by a ignition electrode 5 projecting through combustion air housing shell 3 and the wall of burner assembly 8, with such flame and combustion products being emitted from burner assembly 8 in an annular pattern. It is to be understood that the present invention is not to be considered as limited to this aforedescribed restricting plate arrangement. For example, instead of a spaced restrictor plate 9, a suitable annular restrictor ring can be fastened to the periphery of outlet 6 to provide a narrower centrally disposed outlet. Further, it is within the scope of the present invention to position the narrower extremity of burner assembly 8 adjacent outlet 9 with outlet 9 sized accordingly.

As to fuel atomizer 7, any one of a number of fuel atomizing nozzles can be provided with the burner apparatus of the present invention. Advantageously, nozzle 7 is disclosed as including a centrally disposed compressed air inlet conduit 10 and a fluid fuel inlet conduit 11 disposed at ninety (90°) degrees thereto with nozzle 7 being so positioned relative burner assembly 8 that atomized fuel from nozzle 7 enters burner assembly 8 along the central longitudinal axis thereof.

Figure 3:
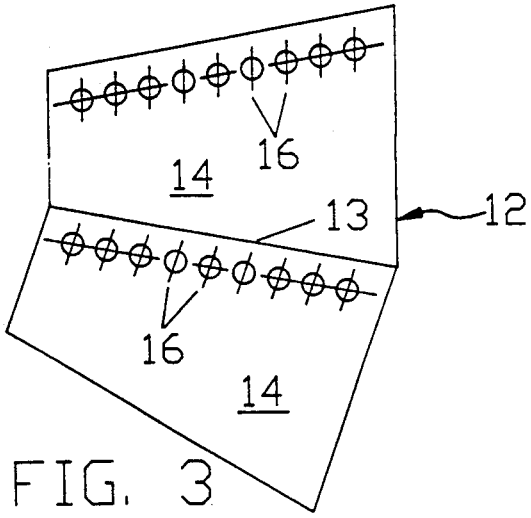
Figure 2:
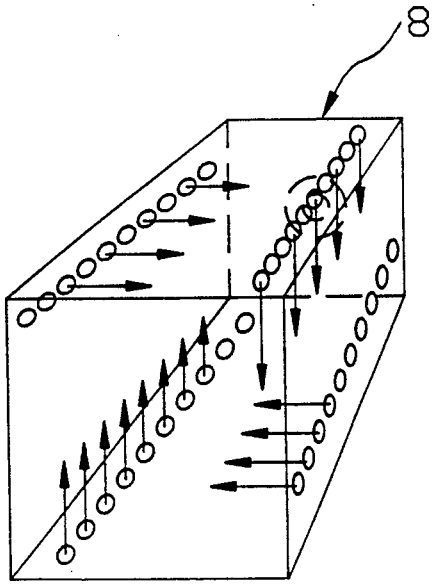
FIG. 2 is a perspective view of one form of the novel frustum shaped burner assembly of FIG. 1, the arrows serving to disclose air stream flow parallel to and along side wall panels forming the burner assembly; and, FIG. 3 is a plan view of one panel set member including two substantially identical joined flat wall panels of frustum shape with a row of selectively positioned apertures in each wall panel, the set member being foldable or bendable along the joining line of the two wall panels to be mated in mirror-image relation with another panel set member to form a frustum shaped burner assembly like that of FIG. 2.

In accordance with one feature of the present invention and referring to FIGS. 2 and 3 of the drawings, it can be seen that frustum shaped burner assembly 8 can be formed from two substantially identical panel sets of turned and joined panels, only one panel set 12 being disclosed in FIG. 3 It is to be understood that this panel set 12 when formed can be turned or bent along the panel joining line 13 at a angle of approximately ninety (90°) degrees and joined by a suitable means such as welding in mirror-image relationship with abutting edges of a second panel set similarly formed and turned so as to provide the frustum shaped burner assembly 8 as disclosed in FIG. 2. Advantageously, each panel set 12 can be formed from a suitable flexible sheet of metal such as type 303 stainless steel of an 18 gauge thickness (0.049 inches). Such material can be stamped and punched in the panel set pattern disclosed to include two similar flat wall panels 14 of frustum shape, integrally joined along common joining line 13. Each flat wall panel 14 is provided with a longitudinally extending line of spaced punched apertures 16, each line of spaced, punched apertures 16 extending parallel to and spaced from a corresponding longitudinally extending side edge of a wall panel member 14. In the construction of a typical miniature type burner of rectangular shape, the opposed wider and narrower edges of each panel member can be spaced apart approximately two and one-half inches (2½") with the wider edge measuring one point eight six two inches (1.862") and the narrower edge naught point nine six seven inches (0.967"). Nine (9) spaced and aligned apertures, each of five thirty two seconds of an inch (5/32") diameter, can be provided in each longitudinally extending row of apertures 16 with their centers spaced approximately one quarter of an inch (¼) from the corresponding side edge to which each is proximate. The outer sloping side edges of each panel set when extended to intersect, define an angle of approximately forty one (41°) degrees. As aforedescribed, joined wall panel members 14 of each panel set 12 are turned at approximately ninety (90) degrees to each other and two so turned panel set members 12 are fastened together along abutting mating edges by welding to provide frustum burner assembly 8 of rectangular cross-section. In the embodiment disclosed, the narrower end of burner assembly 8 can be provided with an apertured end wall through which fuel atomizer nozzle 7 projects to provide a stream of atomized fuel along the central axis of the burner. In accordance with still another feature of the present invention, it is to be noted that ignition electrode 5 can be arranged to project normally through a readily punched aperture in one of the flat wall panels 14 of burner assembly 8 to extend to a point adjacent to and spaced from an opposite wall panel 14, all in a simple, straight-forward construction.

In a typical operation of the apparatus disclosed and pursuant to the novel steps of the inventive method, a stream of compressed air is introduced into conduit 10 of nozzle 7 and, a stream of fluid fuel is introduced normally to the air through conduit 11 with the fuel being atomized by the compressed air stream as it is introduced into the longitudinally extending and expanding confined zone defined by the frustum type burner assembly 8. Additional streams of air introduced into the confined zone of burner assembly 8 from the surrounding combustion air chamber 3 through the lines of punched aperture rows 16 to follow the periphery of the adjacent flat wall panels 14 until impinging against a directly opposite wall panel 14. At this area of impingement, each air stream is agitated to provide air turbulence along spaced longitudinal increments of the confined zone to thoroughly mix with the atomized fuel-air mixture for ignition of the atomized fuel-air mixture by ignition electrode 5, the extremity of which electrode 5 is spaced from and adjacent the periphery of the confined zone along a wall panel member 14. The resulting flame and products of combustion from such ignition are then passed from the confined zone defined by burner assembly 8 in an annular configuration through outlet 6 defined by the space between restrictor plate 9 and the periphery of burner assembly 8.

Thus, a unique and novel combustion apparatus and method of combusting fluid fuel is provided in an efficient, straight-forward and economical manner with a minimum of parts and steps, the arrangement lending itself for ready adaptation to various sizes and demands.

The invention claimed is:

1. A burner assembly for fluid fuels comprising: a burner housing having a plurality of angularly adjoined longitudinally extending flat wall panels to define a burner chamber of preselected geometric configuration with air turbulence forming areas extending longitudinally and primarily along said angularly adjoined flat wall panels to surround a central longitudinal axis of said burner chamber having a fuel inlet means preselectively positioned to introduce fuel into said burner chamber, and combustion air inlet means preselectively positioned only along one longitudinally extending edge of each wall panel with the remaining portion of each wall panel being air impervious to provide a longitudinally extending uninterrupted air path and air barrier portion for an air stream traveling in lines adjacent to and parallel said immediately preceding angularly adjoined flat wall panel to introduce combustion air primarily and principally in substantially even, uniformly flowing streams parallel to and along uninterrupted adjoined flat wall panel portions defining said burner chamber to impinge against opposed longitudinally extending air barrier portions to provide said air turbulence forming areas to provide a thorough fuel-air mixture in said burner chamber; an ignition means cooperatively disposed in said burner chamber to ignite said fuel-air mixture into a flame and combustion products; and, an outlet means for said flame and combustion products.

2. The burner apparatus of claim 1, said angularly adjoining flat wall panels each being in the geometric shape of a trapezoid to provide a frustum-like pyramidical shaped burner assembly with said outlet means of said burner assembly adjacent the narrower extremity of said frustum-like pyramidical burner.

3. The burner apparatus of claim 1, said angularly adjoining flat wall panels each being in the geometric shape of a trapezoid to provide a frustum-like pyramidical shaped burner assembly with said outlet means of said burner assembly adjacent the wider extremity of said frustum-like pyramidical burner.

4. The burner apparatus of claim 1, said outlet means including a flame restraining member cooperating with the periphery of said burner chamber to define an outlet of preselected configuration.

5. The burner apparatus of claim 4 said restraining member being of annular-like form sized and configured to have the outer periphery thereof fastened along the outlet periphery of said burner chamber to define a narrow central outlet for said flame and combustible products.

6. The burner apparatus of claim 4, said restraining member being in the form of a central plate sized to be of narrower configuration than the outlet periphery of aid burner chamber to define an annular outlet for said flame and combustible products.

7. The burner apparatus of claim 1, said fuel inlet means comprising a centrally disposed nozzle including a compressed air inlet and a liquid fuel inlet to provide a combustible atomized fuel mixture to said burner chamber along the central longitudinal axis thereof.

8. The burner apparatus of claim 1, said angularly adjoined flat wall panels including two panel set members, each panel set member of which includes two substantially identical joined flat wall panels of trapezoid shape with each having a plurality of spaced air inlet apertures therein longitudinally extending in a single line spaced from and parallel to one corresponding longitudinally extending side edge of each wall panel to provide said primary and principal combustion air inlet means with said remaining portion extending from an opposite edge of an adjoined panel providing said air barrier portion, each panel set member being folded and said set members joined in mirror-image relation to define a frustum-like pyramidical burner chamber.

9. The burner apparatus of claim 1, said burner assembly being disposed in a surrounding housing having a combustion air inlet therein to provide a combustion air plenum from which air is introduced primarily and principally through aid combustion air inlet means of said burner assembly.

10. An improved combustion apparatus for fluid fuels comprising; a burner housing formed from two substantially identical panel sets of angularly adjoined flat wall panels, each panel set having two substantially identical joined flat wall panels of trapezoid shape with each panel having a plurality of spaced air inlet apertures therein longitudinally extending only in a line adjacent to, spaced from and parallel to a longitudinally extending side edge of each wall panel with the remaining portion of each wall panel being air impervious to provide a longitudinally extending uninterrupted air path and air barrier portion for an air stream traveling along an immediately preceding wall panel to provide primary and principal combustion air inlets, said panel sets being angularly turned and joined in mirror-image relation along adjacent longitudinally extending and abutting edges to form a frustum-like pyramidical shaped burner assembly defining a burner chamber with air turbulence forming areas extending longitudinally along said angularly adjoined flat wall panels and with outlet means at the wider extremity of said frustum-like pyramidical shaped burner and fuel inlet means at the narrower extremity of said frustum-like pyramidical burner and with said combustion air inlets of said burner serving to allow the introduction of combustion air in parallel substantially even, uniformly flowing streams along each of said adjoined flat wall panels to impinge against one of said longitudinally extending remaining air barrier portions to provide said air turbulence forming areas extending longitudinally along said angularly adjoined wall panels defining said burner assembly; an air combustion housing spaced from and surrounding said burner housing to provide a combustion air plenum therebetween, said combustion housing having an air inlet to allow introduction of combustion air into said plenum and primarily and principally through said lines of combustion air inlets of said burner to flow tangentially in substantially even, uniform fashion along the flat panel walls of said burner assembly; a fuel nozzle extending through said combustion housing into fuel inlet means at said narrower extremity of said burner assembly, said nozzle including a compressed air inlet disposed to introduce a compressed air stream along the central longitudinal axis of said nozzle and a liquid fuel inlet disposed to introduce liquid fuel normally to said compressed air stream so as to introduce a combustible atomized fuel mixture at said narrower extremity of said burner assembly; an igniter extending through the side wall of said combustion air housing and normally through one flat wall panel of said burner assembly frustum to ignite the airfuel mixture therein adjacent an opposite flat wall panel; and, a centrally disposed restricting plate at said burner outlet, said plate being sized to be of narrower configuration than the outlet periphery of said frustum-like burner to define an annular outlet for the flame and combustible products of the ignited air-fuel mixture.

11. A method of combusting fluid fuels comprising:

atomizing and introducing atomized fluid fuels into a confined multi-sided combustion zone; introducing air primarily and principally into said confined multi-sided combustion zone only along lines adjacent and parallel junctures of said multi-sided zone to flow in flat parallel substantially even, uniform streams along and substantially parallel adjacent portions of the inner periphery of said confined zone; impinging the air introduced along the periphery of said confined zone against an air barrier at a juncture of said zone formed by air introduced adjacent a preceeding juncture to agitate and create an air turbulent state to mix with the atomized fuel introduced into said zone; igniting the atomized fuel-air mixture in said confined multi-sided zone to provide flame and products of combustion; and, passing the flame and products of combustion from the ignited fuel-air mixture from said confined zone in a controlled manner.

12. The method of combusting fluid fuels of claim 11, wherein the air is introduced into said confined zone and agitated against air barriers extending longitudinally along the periphery of said confined zone.

13. The method of combusting fluid fuel of 11, wherein the atomized fluid is introduced along the central longitudinal axis of said confined zone to mix with the principal air introduced along the periphery of said zone.

14. The method of combusting fluid fuels of claim 11, wherein said fuel-air mixture is ignited along the periphery of said zone.

15. A method of combusting fluid fuels comprising:

air atomizing a stream of fluid fuels and introducing the air atomized fluid fuels into and along the central axis of a longitudinally extending and expanding confined multi-sided combustion zone; introducing air primarily and principally into said longitudinally extending and confined zone only along lines adjacent and parallel junctures of said multi-sided zone to flow in substantially even, uniform streams along and substantially parallel adjacent portions of the longitudinal periphery of aid confined zone; agitating the air introduced in each said line along the longitudinally periphery of said confined multi-sided zone by impinging the air against a longitudinally extending air barrier formed by air introduced at a preceding longitudinal juncture to mix with atomized fuel; igniting the atomized fuel-air mixture adjacent the periphery of said confined zone; and passing the flame and products of combustion from the ignited fuel-air mixture annular from the outer periphery of said confined multi-sided zone.

* * * * *